United States Patent [19]

Harsch et al.

[11] 4,339,781

[45] Jul. 13, 1982

[54] APPARATUS FOR CONTROLLING THE ELECTRIC CURRENT THROUGH AN INDUCTIVE CONSUMER, IN PARTICULAR THROUGH A FUEL METERING VALVE IN AN INTERNAL COMBUSTION ENGINE

[75] Inventors: Klaus Harsch, Ditzingen; Peter Schülzke, Radolfzell-Stahringen, both of Fed. Rep. of Germany

[73] Assignee: Robert Bosch GmbH, Stuttgart, Fed. Rep. of Germany

[21] Appl. No.: 207,056

[22] Filed: Nov. 14, 1980

[30] Foreign Application Priority Data

Dec. 17, 1979 [DE] Fed. Rep. of Germany ..... 2950692

[51] Int. Cl.[3] ..... H01H 47/32

[52] U.S. Cl. ..... 361/154; 123/490; 361/194

[58] Field of Search ..... 361/152, 153, 154, 160, 361/194; 123/490

[56] References Cited

U.S. PATENT DOCUMENTS 4,180,026 11/1979 Schulzke et al. ..... 361/154 X 4,266,261 5/1981 Streit et al. ..... 361/154

*Primary Examiner*—Reinhard J. Eisenzopf

*Attorney, Agent, or Firm*—Edwin E. Greigg

[57] ABSTRACT

An apparatus is proposed for controlling the electric current through inductive consumers, in particular through a fuel metering valve in internal combustion engines, this apparatus representing a two-point closed-loop controller and functioning with a single threshold switch for an upper and a lower threshold. The apparatus includes one current-measuring resistor each in the freerunning circuit and in the main current circuit, both measuring resistors being members of a voltage divider between the two supply voltage lines and whose middle junction is carried to the threshold switch. By means of a resistor-diode network in combination with the threshold switch, a correction can be made in the individual switching thresholds in accordance with supply voltage.

4 Claims, 2 Drawing Figures

APPARATUS FOR CONTROLLING THE ELECTRIC CURRENT THROUGH AN INDUCTIVE CONSUMER, IN PARTICULAR THROUGH A FUEL METERING VALVE IN AN INTERNAL COMBUSTION ENGINE

BACKGROUND OF THE INVENTION

The invention relates to an apparatus for controlling the electric current through an inductive consumer such as a fuel metering valve for an internal combustion engine.

A series circuit comprising the consumer, current resistor and switch between the supply voltage terminals is known, wherein the consumer and the resistor are bridged by a freerunning circuit. The current-switching device is switched ON and OFF in accordance with the flow of current through the measuring resistor in series with the consumer.

It is disadvantageous in this known circuit lay-out that the potentials at the measuring resistor are raised or lowered each time a switchover takes place by an amount of virtually the entire battery voltage. In order to evaluate these signals, quite expensive circuitry is required.

A current-control apparatus has already been proposed which has one measuring resistor each in the main current circuit and in the freerunning circuit. In this apparatus, the voltage drop over each of the two resistors is detected with a separate threshold switch, and their output signals are utilized for the control of the current-control device. In this proposed apparatus, the two current-measuring resistors may be of different dimensions; thus the resistor in the freerunning circuit can also be of larger dimensions than the resistor in the main current circuit, for the purpose of furnishing a more unequivocal signal in the lower current range.

It is one of the objects of the invention to create an apparatus for controlling the electric current through an inductive consumer in which precisely determinable electrical values appear, which are therefore also capable of being precisely processed, on the one hand, while on the other hand the apparatus is favorable in cost.

OBJECTS AND SUMMARY OF THE INVENTION

The invention relates to an apparatus for controlling current to a fuel metering valve having switching and current measuring devices and a threshold switch. A measuring resistor in a free-running circuit delivers a signal, as does the current measuring device to a common threshold switch. Despite the surprisingly simple design of the circuit layout, unequivocally defined electrical signals are obtained, with a simultaneous minimum power consumption.

According to embodiments of the invention, a transistor is included in the free-running circuit which is connected to be blocked at the end of each metering signal. This transistor is connected to provide energizing current to the injection valve magnetic winding. Also, the threshold of the threshold switch can be set according to the supply voltage for the circuit. The advantages will be appreciated from the following description and drawing of the exemplary embodiment.

The invention will be better understood and further objects and advantages thereof will become more apparent from the ensuing detailed description of a preferred embodiment taken in conjunction with the drawings.

DETAILED DESCRIPTION OF THE PREFERRED EMBODIMENT

The exemplary embodiment relates to the final stage of a fuel injection system with intermittent fuel injection in an internal combustion engine. In this system, the magnetic winding of the injection valve acts as an inductive consumer. In principle, however, the circuitry described below may be universally applied wherever inductive switching elements, such as relays, must be controlled rapidly and with precise timing.

Figure 1:
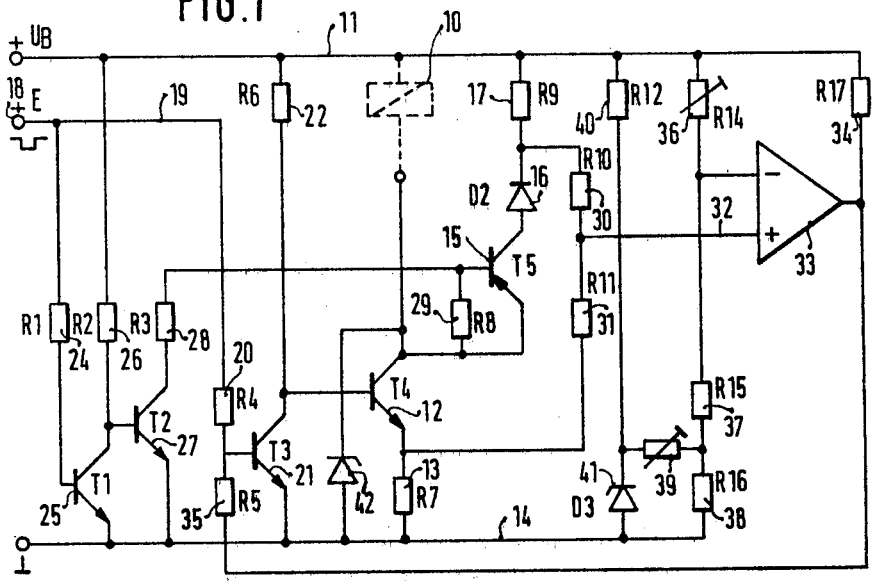
FIG. 1 shows a schematic diagram and circuit lay-out for controlling the electric current through an inductive consumer, in particular a fuel metering valve in an internal combustion engine.

Referring to the drawings, there is shown in FIG. 1, the magnetic winding 10 of the injection valve connected at one end to a positive lead 11 and on the other end, via a transistor 12 and a measuring resistor 13, to a negative lead 14. Parallel to the magnetic winding 10, there is a series circuit comprising a transistor 15, a diode 16 and a resistor 17. The two transistors 12 and 15 are indirectly triggered on the basis of the signal which is present at one input terminal 18. From this input terminal 18, a first line 19 leads via a resistor 20 to the base of a transistor 21, whose emitter is connected to the ground line 14 and whose collector is connected directly to the base of the transistor 12. The collector of the transistor 21 is additionally connected via a resistor 22 to the positive lead 11. A second line leads from the input terminal 18 via a resistor 24 to the base of a transistor 25 which functions in a grounded emitter mode. Its collector is connected via a resistor 26 to the positive lead 11 and is also linked directly with the base of a transistor 27, whose collector in turn is caarried via a resistor 28 to the base of the transistor 15. A further resistor 29 is disposed parallel to the base-emitter path of the PNP transistor 15.

The two resistors 13 and 17 in series with the transistors 12 and 15, respectively, are measuring resistors and together with two further resistors 30 and 31 they represent a voltage divider between the two supply voltage lines 11 and 14. From the junction between the two resistors 30 and 31, a line 32 leads to the positive input of a comparator 33, whose output is connected via one resistor 34 and 35 each with the positive lead 11 and with the base of the transistor 21. The negative input of the comparator 33 is linked with a resistor-diode network between the two supply voltage lines 11 and 14. This network is made up of a voltage divider having three resistors 36, 37, 38, with the negative input of the comparator 33 being connected to the junction of the two resistors 36 and 37 and the junction of the resistors 37 and 38 being conncted via a resistor 39 with the junction of a resistor 40 and a Zener diode 41 between the supply voltage lines.

The final stage of an electromagnetically actuated injection valve illustrated here can be subdivided into three structural groups. The first group represents the switching element for the flow of electric current through the magnetic winding 10 with the transistor 12, the measuring resistor 13 and the preceding transistor 21 along with its circuitry.

The second structural group is the freerunning circuit with the transistor 15, the diode 16 and the resistor 17, including the transistors 25 and 27 which precede the transistor 15. The third structural group is made up of the comparator 33, together with the resistor-diode network and the resistors 30 and 31.

Figure 2:
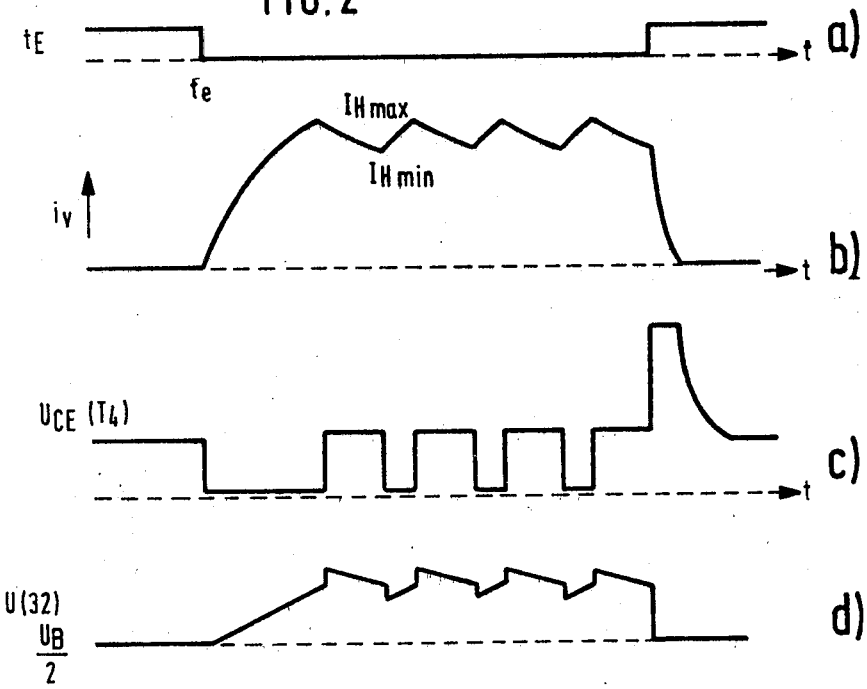
FIG. 2 illustrates chart diagrams of pulses as they occur at specialized points of the circuit layout of FIG. 1.

The subject of FIG. 1 will now be explained with the aid of the pulse diagrams a through d of FIG. 2, which are associated with individual points of the circuit layout of FIG. 1.

FIG. *2a* shows the input signal which is present at the input terminal 18; this signal, in its behavior over time, substantially corresponds to the switching points of the magnetic valve 10.

The current through the magnetic winding 10 of the injection valve is illustrated in FIG. *2b*. FIG. *2c* shows the voltage at the collector of the switching transistor 12, and FIG. *2d* illustrates the course of the potential at the positive input of the comparator 33.

The trigger signal illustrated in FIG. *2a* and which can be applied to the input terminal 18 has a negative triggering edge; that is, at a change of potential in the input signal from positive to zero, the injection valve 10 opens, while correspondingly, at a jump in potential from zero to positive, the magnetic valve closes.

Before the onset of the trigger pulse at time te, the transistor 21 is conductive, and as a result the transistor 12 blocks, so that no electric current flows through the magnetic winding 10 of the injection valve.

At time te, the potential at the input terminal 18 changes to zero, and the comparator output signal is likewise zero; the transistor 21 blocks, and as a result the transistor 12 is conductive, so that the current through the magnetic winding 10 increases. This increase in current causes an increasingly large voltage drop at the measuring resistor 13, as a result of which the voltage at the positive input of the comparator 33 increases. If the established threshold is attained, then the comparator 33 switches, its output voltage moves toward positive, and this in turn results in the transistor 21 switching through and the transistor 12 being blocked. The current through the magnetic winding 10 is now furnished by the freerunning circuit with the transistor 15, the diode 16 and the resistor 17. The voltage drop at the resistor 17, via the voltage divider having the resistors 30 and 31, keeps the potential at the positive input of the comparator 33 positive relative to the negative input, and as a result, the transistor 12 remains blocked. If the current through the magnetic winding 10 is decreasing, then the voltage drop over the resistor 17 becomes smaller, the potential at the positive input of the comparator 33 drops, and the comparator 33 switches the transistor 12 back on at IHmin. The current through the magnetic winding 10 begins once again to increase, and so forth. At the end of the input pulse, the transistors 27 and 12 are blocked; the voltage at the collector of the transistor 12 then increases to such an extent that the magnetic winding current is rapidly dropped via a Zener diode 42 parallel to the series circuit comprising the transistor 12 and the resistor 13.

The switching point for the maximum current can then be expressed as follows:

$$U_{+(33)}=(1-a)\cdot R\ 13\cdot IHmax+a\cdot UB \text{ mit } a=R31/(R30+R31)$$

If the value of the resistor 17 is selected to be about 10% greater than the value of the resistor 13, then directly after the blocking of the transistor 12 the voltage drop at the resistor 17 and thus the measurement value at the positive input of the comparator 33 is correspondingly greater as well. The comparator output signal remains at a high value until such time as the flow of electric current through the magnetic winding 10 has faded to such an extent that the product of the greater measuring resistor and the lesser current, that is, R17·IHmin, again brings about the switching threshold.

The maximum threshold value IHmax can be adjusted via the network preceding the negative input of the comparator 33. The influence of the amplitude of the supply voltage on the switching behavior of the comparator 33 can be adjusted via the size of the resistor 36. Via the resistor 39, a portion (1−a)·R 13·IHmax which is independent of the battery voltage can be added to this voltage value at the negative input of the comparator 33, so that the maximum electric current IHmax flowing in the valve is independent of the battery voltage.

In summary, the following advantages are brought about by the circuit layout shown in FIG. 1:

The two measuring resistors 13 and 17 are connected to fixed reference potentials; that is, they are connected either to the positive lead 11 or to the negative lead 14. As a result, no problems occur with comparators having an in-phase input range.

The good results attained with this circuit layout can be achieved with a single comparator.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for controlling the electric current through an inductive consumer, having first and second ends, of a fuel metering valve for an internal combustion engine, the apparatus including:

first and second voltage supply lines;

a current switching means having first and second ends, a current measuring means which generates a current signal having first and second ends, connected in series with the inductive consumer and the current switching means and connected to the first and second voltage supply lines such that the first voltage supply line is attached to the first end of the inductive consumer, the second end of the inductive consumer is attached to the first end of the current switching means, the second end of the current switching means is attached to the first end of the current measuring means, and the second end of the current measuring means is connected to the second voltage supply line, the apparatus also including:

a freerunning circuit having a measuring resistor which produces a measuring signal with first and second ends wherein the second end is connected to the first voltage supply line;

a blocking means connected to the current measuring means to block current from flowing through the current measuring means during generation of the measuring signal by the freerunning circuit; and a threshold switch having an input, wherein the first end of the measuring resistor is connected to the second end of the inductive consumer and the first end of the current switching means, and wherein the threshold switch input is connected to the first end of the measuring resistor to receive the measuring signal, and wherein the threshold switch input is also connected to the second end of the current switching means and the first end of the current measuring means to receive the current signal.

2. An apparatus as defined by claim 1 including a metering means which generates a metering signal, wherein a switch is disposed in the freerunning circuit, wherein this switch is connected to the metering means to be blocked at the end of each metering signal.

3. An apparatus as defined by claim 1, wherein the threshold switch has a threshold which is selectable in a manner dependent on supply voltage preferably by means of a resistor-diode network connected to the first and second voltage supply lines.

4. An apparatus as defined by claim 1, including a series circuit comprising first, second, third and fourth resistors attached to the first and second voltage supply lines, wherein the first resistor is the measuring resistor, and the fourth resistor is the current measuring means, and wherein the second and third resistors are attached in a junction point which is also attached to the threshold switch input.

* * * * *